US007931491B2

(12) United States Patent
Takahashi et al.

(10) Patent No.: US 7,931,491 B2
(45) Date of Patent: Apr. 26, 2011

(54) FLAT CABLE CONNECTOR

(75) Inventors: Kazuya Takahashi, Zama (JP); Masami Sasao, Machida (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/226,047

(22) PCT Filed: Apr. 13, 2007

(86) PCT No.: PCT/US2007/009057

§ 371 (c)(1),
(2), (4) Date: Aug. 10, 2009

(87) PCT Pub. No.: WO2007/120783

PCT Pub. Date: Oct. 25, 2007

(65) Prior Publication Data

US 2009/0298319 A1 Dec. 3, 2009

(30) Foreign Application Priority Data

Apr. 13, 2006 (JP) ..... 2006-111223

(51) Int. Cl.
*H01R 3/00* (2006.01)

(52) U.S. Cl. ..... 439/495

(58) Field of Classification Search ..... 439/495, 439/260, 329

See application file for complete search history.

(56) References Cited

U.S. PATENT DOCUMENTS

| | | | | |
|---|---|---|---|---|
| 5,173,058 | A * | 12/1992 | Broeksteeg et al. | 439/267 |
| 6,471,541 | B2 * | 10/2002 | Kunishi et al. | 439/495 |
| 6,726,497 | B2 * | 4/2004 | Nogawa et al. | 439/260 |
| 7,044,773 | B2 * | 5/2006 | Suzuki et al. | 439/495 |
| 7,112,079 | B2 * | 9/2006 | Miura et al. | 439/260 |
| 7,179,107 | B2 * | 2/2007 | Shen et al. | 439/267 |
| 7,179,118 | B1 * | 2/2007 | Harlan et al. | 439/495 |
| 7,223,110 | B2 * | 5/2007 | Suzuki et al. | 439/260 |
| 7,255,584 | B2 * | 8/2007 | Takashita | 439/260 |
| 7,261,588 | B2 * | 8/2007 | Yokoyama | 439/495 |
| 7,275,948 | B2 * | 10/2007 | Miura et al. | 439/260 |
| 7,311,542 | B2 * | 12/2007 | Suzuki | 439/260 |
| 7,347,720 | B2 * | 3/2008 | Takashita | 439/495 |

(Continued)

FOREIGN PATENT DOCUMENTS

EP 0 895 320 A2 2/1999

(Continued)

OTHER PUBLICATIONS

International Search Report for PCT/US2007/009057.

*Primary Examiner* — T C Patel
*Assistant Examiner* — Vladimir Imas
(74) *Attorney, Agent, or Firm* — Timothy M. Morella

(57) ABSTRACT

A cable connector comprising having a housing with an opening for receiving an end of a flat cable therein. The housing also has a plurality of terminal recesses, and a plurality of conductive terminals disposed in the recesses for connecting to conductive leads of the flat cable. The terminals are provided with solder connecting portions for adhering to conductive pads by soldering, and contact portions for contacting the flat cable conductive leads. The terminals recesses are at least partly defined by terminal holding walls confronting external surfaces of the terminals received therein, by broad width portions, and a cut-away portions formed between parts in the terminals holding walls, the parts facing the terminal solder connecting portions and contact portions, respectively.

5 Claims, 8 Drawing Sheets

U.S. PATENT DOCUMENTS

| | | | | |
|---|---|---|---|---|
| 7,491,088 | B2 * | 2/2009 | Suzuki et al. | 439/607.01 |
| 7,540,764 | B2 * | 6/2009 | Suzuki et al. | 439/495 |
| 2005/0136732 | A1 | 6/2005 | Suzuki | |

FOREIGN PATENT DOCUMENTS

| | | | |
|---|---|---|---|
| EP | 1 049 200 | A2 | 11/2000 |
| EP | 1 083 631 | A1 | 3/2001 |
| EP | 1 311 028 | A2 | 5/2003 |
| JP | 2002-270290 | | 9/2002 |
| JP | 2003-109695 | | 4/2003 |
| JP | 2004-178959 | | 6/2004 |
| JP | 2005-078908 | | 3/2005 |
| WO | WO 03/083999 | A1 | 10/2003 |

* cited by examiner

FIG.15
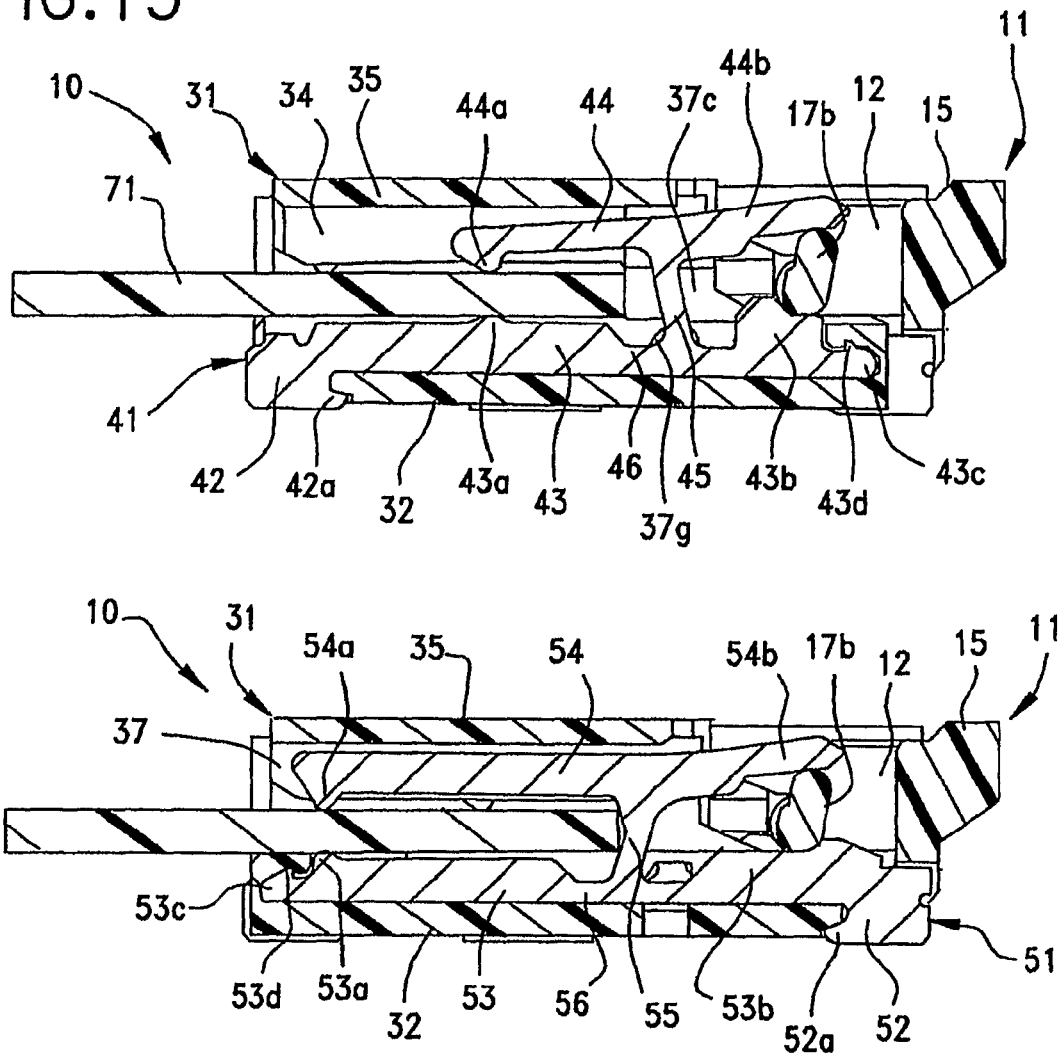
FIG.16
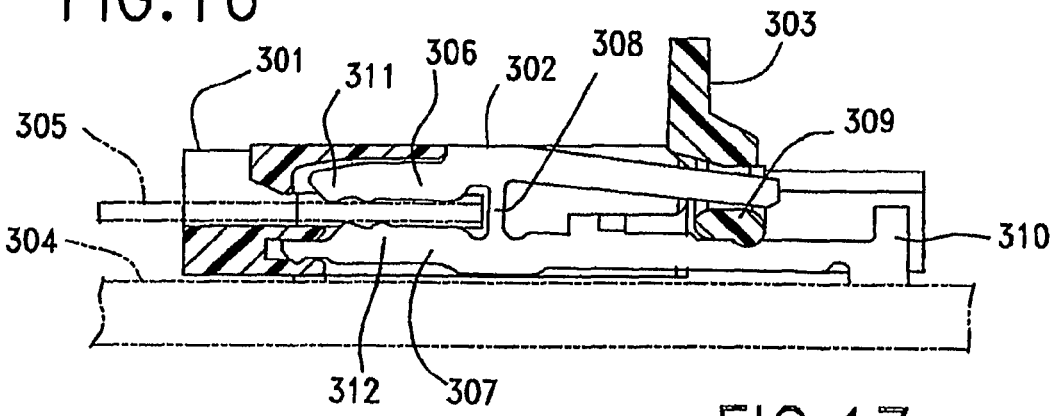
FIG.17
(PRIOR ART)

FLAT CABLE CONNECTOR

BACKGROUND OF THE INVENTION

The present invention generally relates to a flat cable connector, and more particularly to one with improved mounting characteristics.

Conventional flat cable connectors are used to connect flat flexible cables called flexible printed circuit (FPC), flexible flat cable (FFC) or the like, as shown in Japanese Patent Application Laid-Open (Kokai) Publication No. 2002-270290.

FIG. 17 is a cross-sectional view of such a conventional cable connector.

As shown in FIG. 17, the connector includes a housing 301 made from an insulating material, a plurality of conductive terminals 302 which are held by the housing 301, and an actuator 303, also made from an insulating material, which is secured to the housing 301 so that the actuator 303 can move relative to the housing 301. The connector is mounted on a substrate 304 such as a circuit board, and a flat cable 305 inserted in an opening of the housing 301 is connected to the cable connector. Each of the terminals 302 has an H-shape, and includes an upper portion 306 that extends on the upper side of the terminal 302 in the insertion direction of the flat cable 305, a lower potion 307 that extends on the lower side of the terminal 302 in the insertion direction of the flat cable 305, and a thin and long belt-shaped connecting spring portion 308 for connecting the middle parts of the upper portion 306 and the lower portion 307 together. A tail portion 310 projected downward is connected in a manner such that it is fixed by solder to a connecting pad (not shown) formed on the surface of the substrate 304 by the use of reflow solder.

When the actuator 303 is at an open position as shown in FIG. 17, a space formed between a contacting portion 311 of the terminal upper portion 306 and a contacting portion 312 of the terminal lower portion 307 of each of the terminals 302 expand so that the flat cable 305 can be inserted into or removed from the housing opening. Once the actuator 303 is moved from the open position to a closed position while the flat cable 305 is inserted into the space between the terminal contacting portions 311 and 312, an oval-shaped rotation shaft 309 rotates and the rear portions of the upper portion 306 and the lower portion 307 of the terminal 302 are pushed apart from each other. Therefore, the space between the contacting portion 311 of the terminal upper portion 306 and the contacting portion 312 of the terminal lower portion 307 is narrowed and the flat cable 305 is sandwiched between them. Accordingly, conductive leads (not shown) of the flat cable 305 contact the contacting portions 311, 312 and are connected to the terminals 302. In this case, as the connecting spring portion 308 is elastically deformed, the terminal upper portion 306 rotates counterclockwise about a connecting point where it is connected to the connecting spring portion 308, and the terminal contacting portion 311 of the upper portion 306 moves downward to thereby sandwich the flat cable 305 in between it at the contacting portion 312 of the lower portion 307.

However, in the conventional cable connector, when the tail portion 310 is connected to the connecting pad on the surface of the substrate 304 by the use of reflow solder, flux component contained in the solder may creep up along the side surfaces of the terminals 302, causing a flux-creep-up and contamination problem. Once the flux adheres to the terminal contacting portions 311 and 312, a failure in contact occurs between the contacting portions 311 and 312, and the cable conductive leads, which results in losing electrical conduction between the terminals 302 and the cable leads. The flux, after solidifying, bonds the upper portion 306 and a wall of the housing 301, and accordingly the upper portion 306 becomes unable to rotate.

This problem occurs for the reason that when the terminals 302 are fitted into accommodating grooves of the housing 301, the flux creeps up similar to capillary action, and enters gaps between the terminals 302 and the accommodating grooves. Since molten flux has a higher fluidity than the molten solder, it can flow through even a tiny gap that solder could not pass through. Therefore, even though a creep-up of the solder can be prevented, it has been difficult to ensure prevention of a creep-up of flux.

SUMMARY OF THE INVENTION

The present invention has an object to provide a highly-reliable cable connector with a simple construction. A cable connector is obtained by including terminal holding recess portions which accommodate and hold terminals, each having a solder connecting portion to be soldered and a contacting portion for contacting to conductive leads of a flat cable, and also including broad width portions or cut-away portions formed at least in a part of areas in terminal holding walls of the terminal holding recess parts, between the solder contacting portions and contacting portions. Thus, even with a simple construction, flux-creep-up is reliably diminished, the contacting portions of the terminals are not contaminated by flux, and movable portions of terminals are not adhered to terminal holding recess parts by the flux.

In order to achieve the above-mentioned object, a cable connector according to the present invention includes a housing with an opening that receives a flat cable. The housing has a terminal holding recess portion, and terminals are held in the terminal holding recess portion and connected to leads of the flat cable. The terminals are provided with solder connecting portions for soldering, and contacting portions are configured to come into contact with the cable leads, and the terminal holding recess portion is provided with holding walls facing external surfaces of the terminals, and a broad width portion or a cut-away portion is formed between portions of the terminal holding wall, which corresponds to the solder connecting portions and to the contacting portions.

In another cable connector of the invention, the broad width portion or the cut-away portion is formed between portions in the terminal holding wall and they correspond to the solder connecting portions and the movable portions of the terminals.

In yet another cable connector of the present invention, the broad width portion or the cut-away portions are formed in portions of the terminal holding wall, and they correspond to the movable portions of the terminals.

Yet another cable connector of the present invention includes an actuator that is moveable between a first position at which the flat cable can be inserted, and a second position at which the cable leads and the terminals are connected to each other. The terminals are provided with first and second arm portions that extend in an insertion direction of the cable, and thin and long belt-shaped connecting portions that connect the first and second arm portions together. The broad width or cut-away portion is formed between the terminal holding walls, the portions corresponding to the connecting solder portions and to the connecting portions.

In accordance with the present invention, terminal holding recess portions are provided in the housing for holding the terminals in place. Each terminal has a solder connecting portion to be soldered and a contacting portion for contacting the cable leads, and broad width portions or cut-away portions are formed at least in portions of the terminal holding walls of the terminal holding recess portions, between the terminal solder contacting portions and contacting portions. Therefore, a flux-creep-up can be avoided, the contacting portions of the terminals are not contaminated by flux, and movable portions of terminals are not adhered to terminal holding recess parts by flux, thus obtaining a highly-reliable cable connector.

BRIEF DESCRIPTION OF THE DRAWINGS

FIG. 15 is a cross-sectional view of the connector of FIG. 13, taken along the line E-E thereof;

FIG. 16 is a cross-sectional view of the connector of FIG. 14, taken along the line F-F thereof;

FIG. 17 is a cross-sectional view of a main part of a conventional cable connector;

DESCRIPTION OF THE PREFERRED EMBODIMENTS

Figure 1:
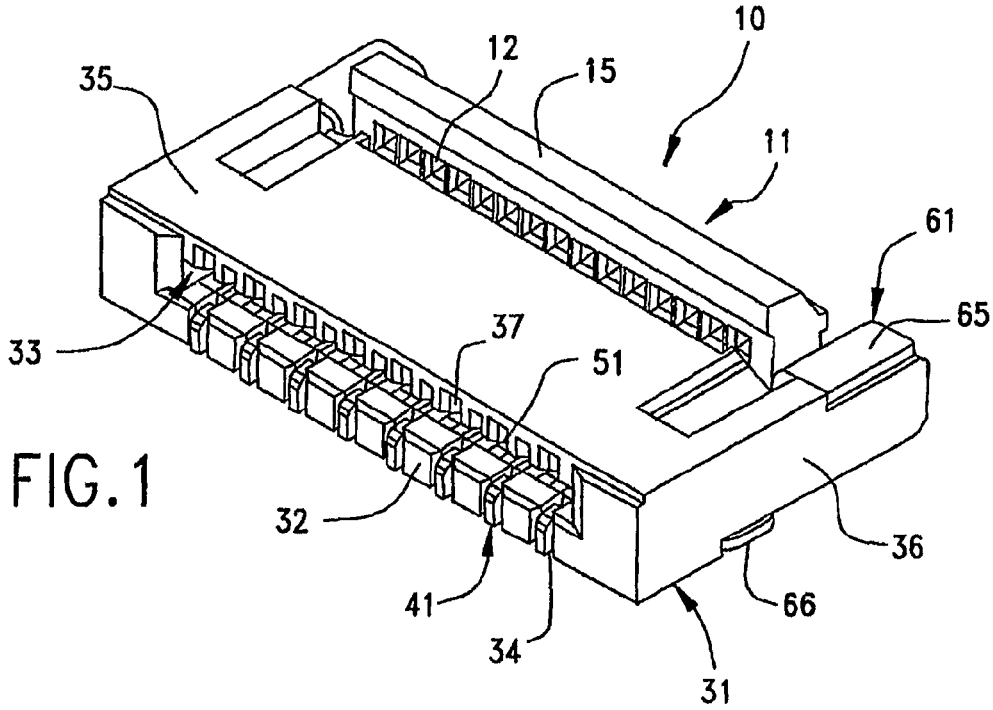
FIG. 1 is a perspective view of a connector constructed in accordance with the principles of the present invention with its actuator in an up and open position.
Figure 2:
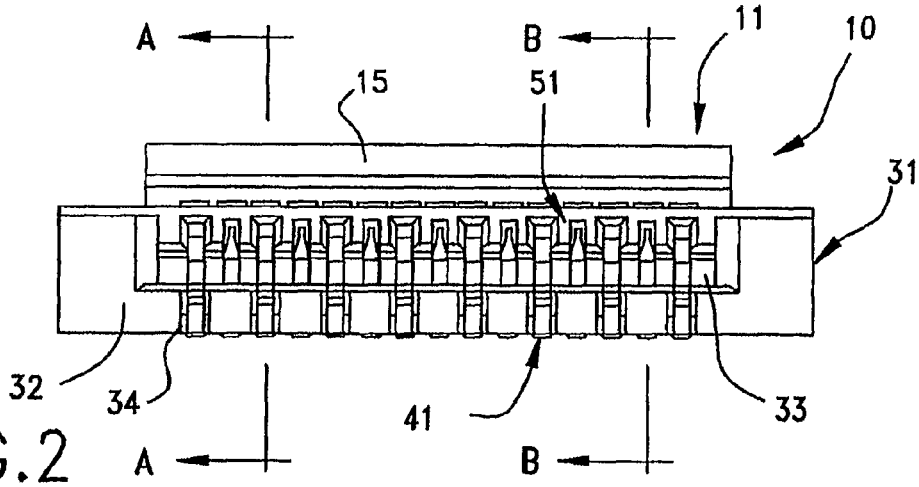
FIG. 2 is a front elevational view of the connector of FIG. 1.
Figure 3:
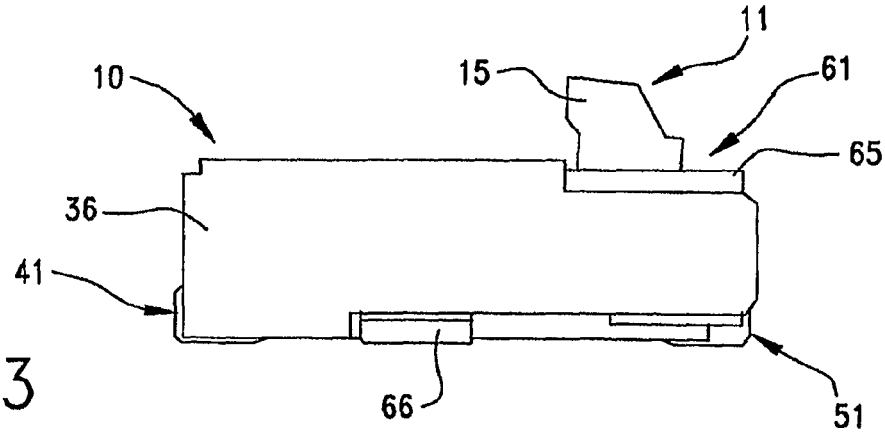
FIG. 3 is a side elevational view of the connector of FIG. 1 with its actuator open.
Figure 4:
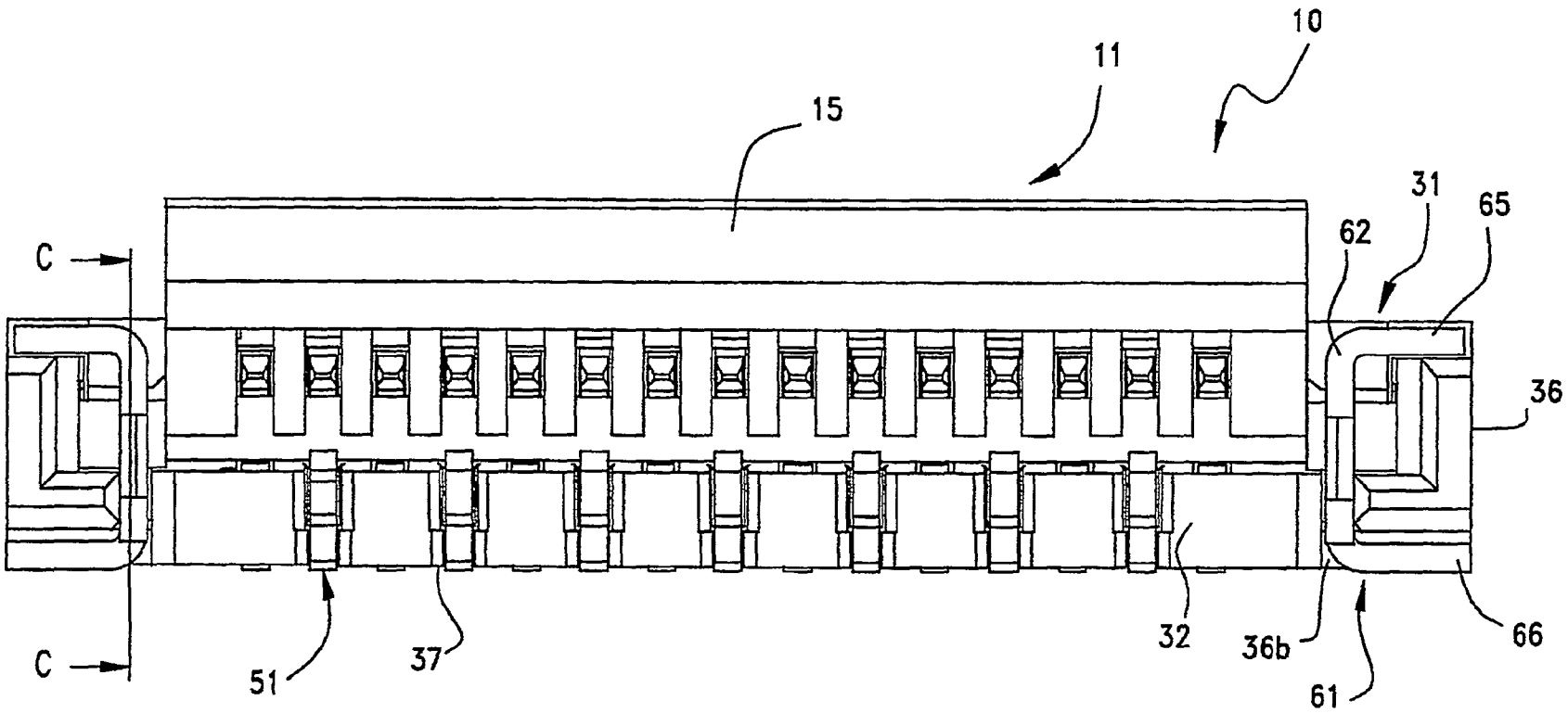
FIG. 4 is a rear view of the connector of FIG. 1 with its actuator open.

FIG. 1 is perspective view of a cable connector of the present invention. This cable connector 10 is mounted on a substrate (not shown) such as a circuit board, and is used for connecting a flat cable 71, which is called a flexible printed circuit, a flexible flat cable or the like, to the substrate. The flat cable 71 is commonly called FPC, FFC, or the like. However, any type of cable may be used as long as it is flat and has conductive leads. Note that, in this embodiment, the expressions for directions including up, down, left, right, front, and, rear, that are used to explain structures and operations of each constituent of the connector 10, do not represent absolute directions but do explain relative directions.

The connector 10 includes a housing 31 and an actuator 11. The housing 31 is formed as one piece of insulating material such as a synthetic resin, and the actuator 11 is formed as one piece of an insulating material and is mounted on the housing 31 that it can move between an open position (first position) to a closed position (second position).

The housing 31 includes a lower portion 32, an upper portion 35, side portions 36 on the left and right sides, and a cable insertion opening 33 formed in the front of the housing 31 between the lower, upper and the side portions 36 for receiving an end of a flat cable 71. In this opening 33, a plurality of terminal holding recesses (grooves) are formed to hold the terminals.

The terminals include distinct first terminals 41 and second terminals 51, and the terminal holding recesses include first terminal recess portions 34 for holding the first terminals 41 and second terminal recesses 37 for holding the second terminals 51. The first terminals 41 and the second terminals 51 are metal and the number of the first terminal recesses 34 and the second terminal recesses 37 are, for example, fifteen in total, with an about 0.3 mm-pitch. The pitch and number of these recesses, or grooves, may be appropriately varied as required. Also, the first terminal recesses 34 and the second terminal recesses 37 are disposed alternately so that the first and second terminals 41 and 51 are positioned next to each other. The first and second terminals 41, 51 do not have to be fitted in all of their respective recesses; some may be omitted as necessary according to the number and position of conductive leads provided in the flat cable 71.

Figure 7:
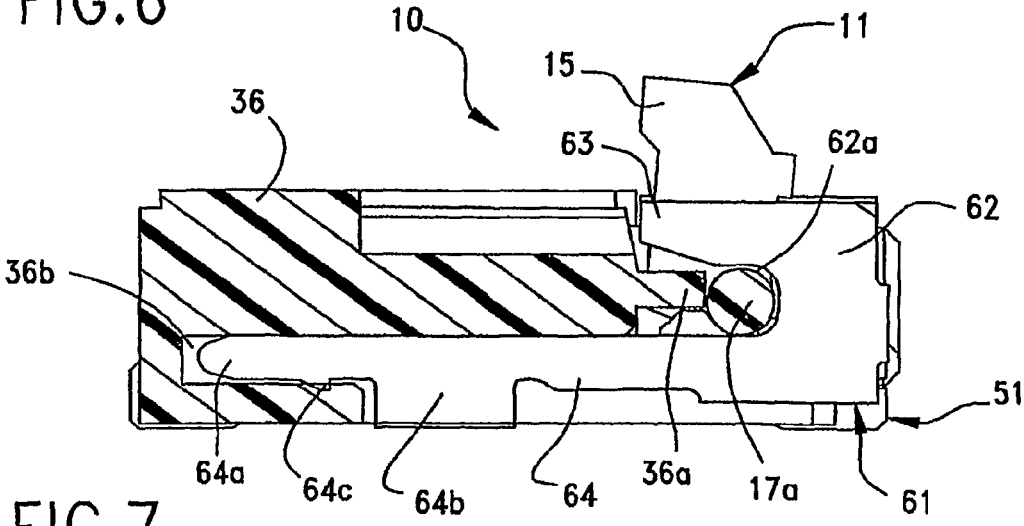
FIG. 7 is a lengthwise cross-sectional view of the connector of FIG. 4, taken along the line C-C thereof.

As shown in FIG. 7, in each of the side portions 36 of the housing 31, a nail accommodating recess **36*b* is provided to extend in the insertion direction of the flat cable 71. A metal nail 61 is received in the nail accommodating recess 36*b* as an auxiliary connector fixing bracket. It is preferred that each of the nails 61 be provided with a main body 62, an upper beam portion 63 and a lower beam portion 64 projecting frontward from the main body 62 and extending in the insertion direction of the flat cable 71, an upper projecting portion 65 connected to the upper end of the main body 62 and provided to extend in the horizontal direction, and a lower projecting portion 66 connected to the bottom end of the lower beam portion 64 via a connecting portion 64*b*** and provided to extend in the horizontal direction.

The nails 61 are inserted and fitted into the nail accommodating recess portions **36*b* on the left and right sides, respectively, from the rear side (the right side in FIG. 7) of the housing 31. In this case, a tip portion 64*a* of the lower beam portion 64 is completely press-fitted into the nail accommodating recess portion 36*b*, and a projection 64*c* projecting downward from the bottom end of the tip portion 64*a* forcedly engaged into the floor surface of each of the nail accommodating recess parts 36*b*. This strengthens a connection between the lower beam portions 64 and the housing 31. The lower projecting portion 66 is fixedly secured to the surface of the substrate by soldering or the like. Further, the upper projecting portion 65 is positioned above the top surface of each side portion 36 of the housing 31, restricting an upward movement of the housing 31. Therefore, the attachment of the connector 10 to the substrate is rigid, thus preventing the connector 10** from being detached from the substrate.

The upper beam portion 63 and the lower beam portion 64 are connected to each other by the main body 62 at their rear end portions, forming an approximately U-shaped bearing groove **62*a* which opens towards the front. In this bearing groove 62*a*, a first shaft portion 17*a* located on both sides of the actuator 11 is accommodated as a shaft portion. Note that the first shaft portion 17*a* has an approximate circular shape in cross section. Further, a positioning projection 36***a* formed in each of the side portions 36 of the housing 31 enters the bearing groove 62*a* from the front, restricting movements of the first shaft portion 17*a* to the front of the bearing groove 62*a*. Hence, the first shaft portion 17*a* is positioned at the rear end of the bearing groove 62*a* and rotates at that position. To this end, the actuator 11 can change its position and attitude without being retracted from the housing 31. In other words, the nail 61 also can work as a supporting and stopping member for the actuator 11.

Figure 5:
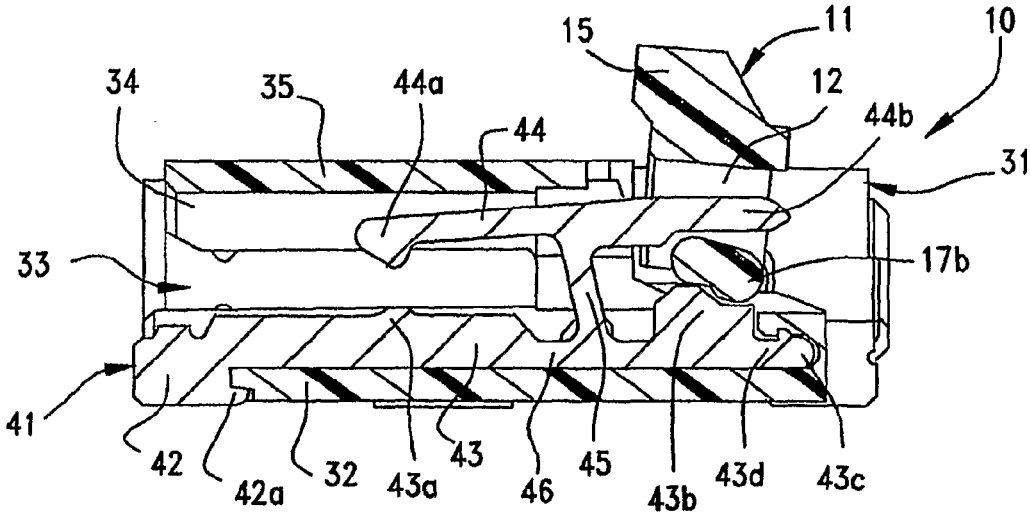
FIG. 5 is a cross-sectional view of the connector of FIG. 2, taken along the line A-A thereof with the actuator open.
Figure 6:
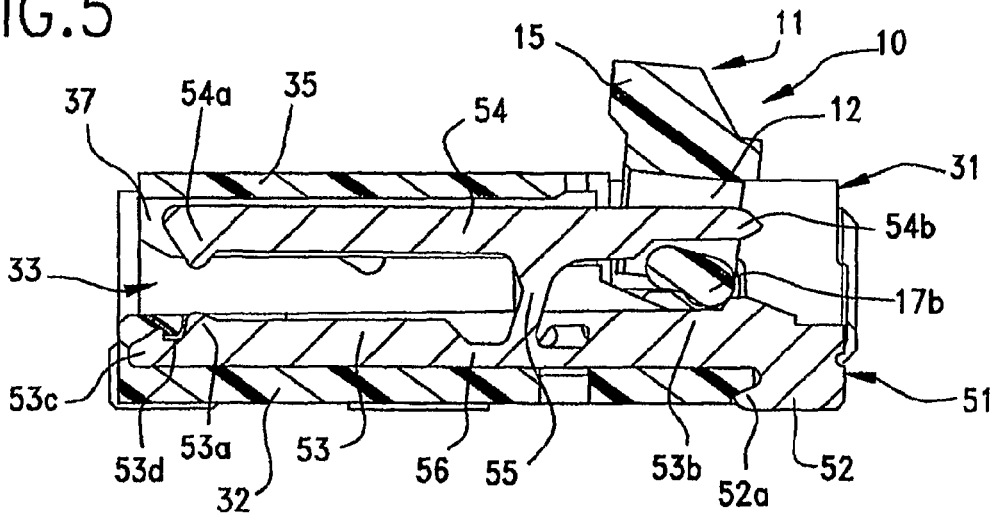
FIG. 6 is a cross-sectional view of the connector of FIG. 2, taken along the line B-B thereof with the actuator open.

The actuator 11 includes a main body 15, a plurality of terminal accommodating holes 12 formed in the main body 15, and a second shaft portion 17*b* formed in the terminal accommodating holes 12 as a shaft portion. As shown in FIGS. 5 and 6, each of the terminal accommodating holes 12 accommodates an actuating layer portion 44*b* of an upper arm portion 44 of the first terminal 41, and an actuating lever portion 54*a* of an upper arm portion 54 of the second terminal 51. The second shaft portion 17*b* is engaged with the actuating lever portions 44*b* and 54*b*.

Further, as shown in FIG. 5, each of the first terminals 41 has an approximate H-shape, and includes a lower arm portion 43 as a first arm portion and the upper arm portion 44 as a second arm portion, both extending in the insertion direction of the flat cable 71, as well as a thin and long (belt-shaped) connecting portion 45 which provides a connection between the lower arm and upper arm portions 43, 44. The connecting portion 45 is connected at the middle of the lower arm portion 43 between the opposite ends thereof, and is also connected to a position at the middle of the upper arm portion 44 between the opposite ends thereof Also, a connecting area portion 46 of the lower arm portion 43, which is a predetermined area including a connecting point to the connecting portion 45, is shaped to have the same width as that of the connecting portion 45.

Here, at the tip (on the left side in FIG. 5) of the lower arm portion 43, a tail portion 42 is formed. This tail portion 42 is a solder-connecting portion which is projected downward and is to be connected by soldering to a connecting pad formed on the surface of the substrate. In addition, the lower arm portion 43 is provided with a cable supporting portion 43*a* arranged to project upward at a position between the tip and connecting area portion 46, a bearing portion 43*b* connected to the rear end (the right side in FIG. 5) of the connecting area portion 46 and supporting the second shaft portion 17*b* from the bottom, and a rear end projecting portion 43*c* extended to the rear side from the rear end of the bearing portion 43*b*. Note that a projection 43*d* projecting upward is formed on the top end of the rear end projecting portion 43*c*.

Each of the first terminals 41 is inserted into each of the first terminal recesses portions 34 from the front side (left in FIG. 5) of the housing 31. The lower end portion of the lower arm portion 43 abuts the floor surface of the first terminal recess 34, and the rear end portion 43*c* fits into the deep hole portion of the first terminal recess 34. In addition, the projection 43*d* is tightly engaged into the sealing surface of the hole part or recess, and the projection 42*a* of the tail 42 is tightly engaged into the bottom of the front end of the lower portion 32 of the housing 31. Thus, each of the first terminals 41 is fixedly fitted in the housing 31.

The upper arm portion 44 also works as a contacting piece which is contacts the conductive leads of the flat cable 71. The tip of the upper arm portion 44 has a contact portion 44*a* to project as a contact part. The upper arm portion 44 is provided with actuating lever portion 44*b* which extends to the rear of a connecting point to the connecting portion 45 and enters the terminal accommodating hole 12 of the actuator 11 to restrict upward movement of the second shaft portion 17*b*.

The second shaft portion 17*b* has an approximate oval shape in cross-section, is located between the bearing portion 43*b* and the actuating lever portion 44*b*, and works as a cam by rotating in order to push up the actuating lever portion 44*b*. Once the actuating lever portion 44*b* is pushed up, the connecting portion 45 and the connecting area portion 46 are elastically deformed, and the whole upper arm portion 44 rotates so that a relative angle between the upper arm portion 44 and the lower arm portion 43 is changed, and the tip of the upper arm portion 44 moves downward. Thus, the contact portion 44*a* moves closer to the cable supporting portion 43*a* and is pressed against the conductive leads of the flat cable 71.

Note that, as shown in FIG. 5, when the actuator 11 is at the open position, the second shaft portion 17*b* is in a position substantially close to a horizontal position thereof. In other words, in the second shaft portion 17*b* which is approximately oval, the longer axis of its cross section is nearly horizontal. Therefore, the actuating lever portion 44*b* is not pushed up, and the tip of the upper arm portion 44 is not moved downward. Hence, a space between the contact portion 44*a* and the cable supporting portion 43*a* is widened enough, and therefore, the frontmost end portion of the flat cable 71 inserted from the insertion opening 33 receives no or only least contact pressure from the contact portion 44*a* and the cable supporting portion 43*a* when inserted. This means that a substantial ZIF (zero insertion force) structure can be realized.

Moreover, as shown in FIG. 6, each of the second terminals 51 has an approximate H-letter shape, and includes a lower arm portion 53 as a first arm portion and an upper arm portion 54 as a second arm portion, both being extended in the insertion direction of the flat cable 71, as well as a thin and long belt-shaped connecting portion 55 which provides a connection between the lower arm portion 53 and the upper arm portion 54. This connecting portion 55 is connected to a position at the middle of the lower arm portion 53 between the longitudinal opposite ends thereof, and also connected to a position at the middle of the upper arm portion 54 between the longitudinal ends thereof. Note that the upper arm portion 54 is disposed above the lower arm portion 53. Also, a connecting area portion 56 of the lower arm portion 53, which is a predetermined area including a connecting point to the connecting portion 55, is shaped to have the same width as that of the connecting portion 55.

Here, the lower arm portion 53 includes a tip projection portion 53*c* provided to forwardly project from the tip (on the left most side in FIG. 6) of the lower arm portion 53, a cable supporting portion 53*a* positioned at the rear of the tip projecting portion 53*c* and provided to project upward, and the bearing portion 53*b* connected to the rear end (the right end in FIG. 6) of the connecting area portion 56 and supporting the second shaft portion 17*b* from the bottom. Further, to the rear end of the bearing portion 53*b*, a tail portion 52 is affixed to form a solder-connecting portion projecting downward and connected to a connecting pad formed on the surface of the substrate. Note that a projection 53*d* is formed to project upward from the upper end of the tip projecting portion 53*c*.

Each second terminal 51 is fit into each second terminal recess 37 from the rear (right in FIG. 6) of the housing 31. A lower end portion of the lower arm portion 53 abuts the floor of each of the second terminal recess 37, and the tip projecting portion 53*c* fits into a hole part at the tip end of each of the second terminal recess 37, so that the projection 53*d* is tightly engaged with the ceiling surface of the hole part. The projection 52*a* is tightly engaged with the bottom end of the rear end surface of the lower portion 32 of the housing 31 to fix the second terminals 51 to the housing 31.

Moreover, the upper arm portion 54 also works as a contacting piece which is electrically connected to the conductive leads of the flat cable 71. Near the tip of the upper arm portion 54, a contact portion 54*a* is projected downward as a contact portion. Moreover, the upper arm portion 54 is provided with an actuating lever portion 54*b* which is provided to extend toward the rear side of a connecting point at which it is connected to the connecting portion 55 and enters the terminal accommodating hole 12 of the actuator 11 to restrict any upward movement of the second shaft portion 17*b*.

The second shaft portion 17*b* has an approximate oval in cross-section, is located between the bearing portion 53*b* and the actuating lever portion 54*b*. The second shaft portion 17*b* works as a cam upon being rotated to thereby push up the actuating lever portion 54*b*. Once the actuating lever portion 54*b* is pushed up, the connecting portion 55 and the connecting area portion 56 are elastically deformed, and the whole upper arm portion 54 rotates so that a relative angle between the upper arm portion 54 and the lower arm portion 53 varies, and the tip of the upper arm portion 54 moves downward. Thus, the contact portion 54*a* moves closer to the cable supporting portion 53*a* and is pressed against the conductive leads of the flat cable 71.

Note that, as shown in FIG. 6, when the actuator 11 is at the open position, the second shaft portion 17*b* takes a substantially horizontal position. Therefore, the actuating lever portion 54*b* is not pushed up, and the tip of the upper arm portion 54 is not moved downward. Hence, since a space between the contact portion 54*a* and the cable supporting portion 53*a* is widened enough, the frontmost portion of the flat cable 71 inserted from the insertion opening 33 receives no or only less contact pressure from the contact portion 54*a* and the cable supporting portion 53*a* during insertion. This means that a substantial ZIF structure is realized.

Incidentally, as shown in FIG. 6, in each of the second terminals 51, the positions of the contact portion 54*a* and the cable supporting portion 53*a* are arranged adjacent to the front end face of the lower portion 32 of the housing 31 relative to the insertion direction of the flat cable 71. On the other hand, in each of the first terminals 41, as shown in FIG. 5, the positions of the contact portion 44*a* and the cable supporting portion 43*a* are spaced apart from the front end face of the lower portion 32 of the housing 31 toward the rear side with respect to the insertion direction of the flat cable 71. This arrangement is adopted for substantially equalizing the length of a conductive path running from the contact portion 44*a* to the tail portion 42 to that of a conductive path running from the contact portion 54*a* to the tail portion 52, for the purpose of obtaining an identical electrical resistance with the first and second terminals 41 and 51. Hence, the respective positions where electric connections are established between the conductive leads juxtaposed on the flat cable 71 and the first and second terminals 41 and 51 are distant away from each other and accordingly, occurrence of any crosstalk can be prevented between the neighboring conductive leads.

Note that the positions of the contact portion 44*a* and the cable supporting portion 43*a* relative to the insertion direction of the flat cable 71 are set to be the same as one another. In other words, it is preferred that the contact portion 44*a* and the cable supporting portion 43*a* are positioned to confront each other. The positions of the contact portion 54*a* and the cable supporting portion 53*a* are also the same. Further, the positions of the contact portion 44*a* and the cable supporting portion 43*a*, and the positions of the contact portion 54*a* and the cable supporting portion 53*a*, relative to the insertion direction of the flat cable 71 are not limited to the examples in FIGS. 5 and 6, and can be appropriately varied as required.

Furthermore, the bearing portion 43*b* of each of the first terminals 41 is provided with a projection protruding upward near the front end thereof. This projection is effective for restricting a frontward movement of the second shaft portion 17*b* to some extent. Moreover, the bearing portion 53*b* of each of the second terminals 51 is provided with a projection protruding upward near the rear end thereof. This projection is effective for restricting any rearward movement of the second shaft portion 17*b*.

Next, a construction of a terminal holding wall of each of the terminal holding recess portions will now be described in detail. Here, one of the second terminal holding recess parts 37 will be explained as an example.

Normally, when the solder connecting portion of a terminal is connected to the connecting pad formed on the surface of the substrate by soldering, a "flux-creep-up" happens where flux component contained in a solder is melted and creeps up along the surface of the terminal. In this case, flux creeps up mainly along the side surfaces of the terminals. Therefore, in this embodiment, in order to prevent this flux-creep-up from happening, either broad width portions or a cut-away portion 37*g* (FIGS. 9-10) is formed on the surface of the terminal holding wall of each of the respective second terminal holding recess parts 37, in which the above-mentioned surface is disposed to confront to the side surface of the second terminal 51. In other words, the broad width portions or the cut-away portions 37*g* are formed on the side wall of the second terminal holding recess portions 37.

As shown in FIGS. 9 through 12, a first narrow width portion 37*a*, a first broad width portion 37*b*, a second broad width portion 37*c*, a third broad width portion 37*d*, a second narrow width portion 37*e*, a third narrow width portion 37*f*, and the above-mentioned cut-away portion 37*g* are formed on the side wall of each of the second terminal holding recess portions 37. Note that the first narrow width portion 37*a*, the second narrow width portion 37*e*, and the third narrow width portion 37*f* may be generally explained as narrow width portions, and the first broad width portion 37*b*, the second broad width portion 37*c* and the third broad width portion 37*d* may be generally explained as broad width portions.

Figure 8:
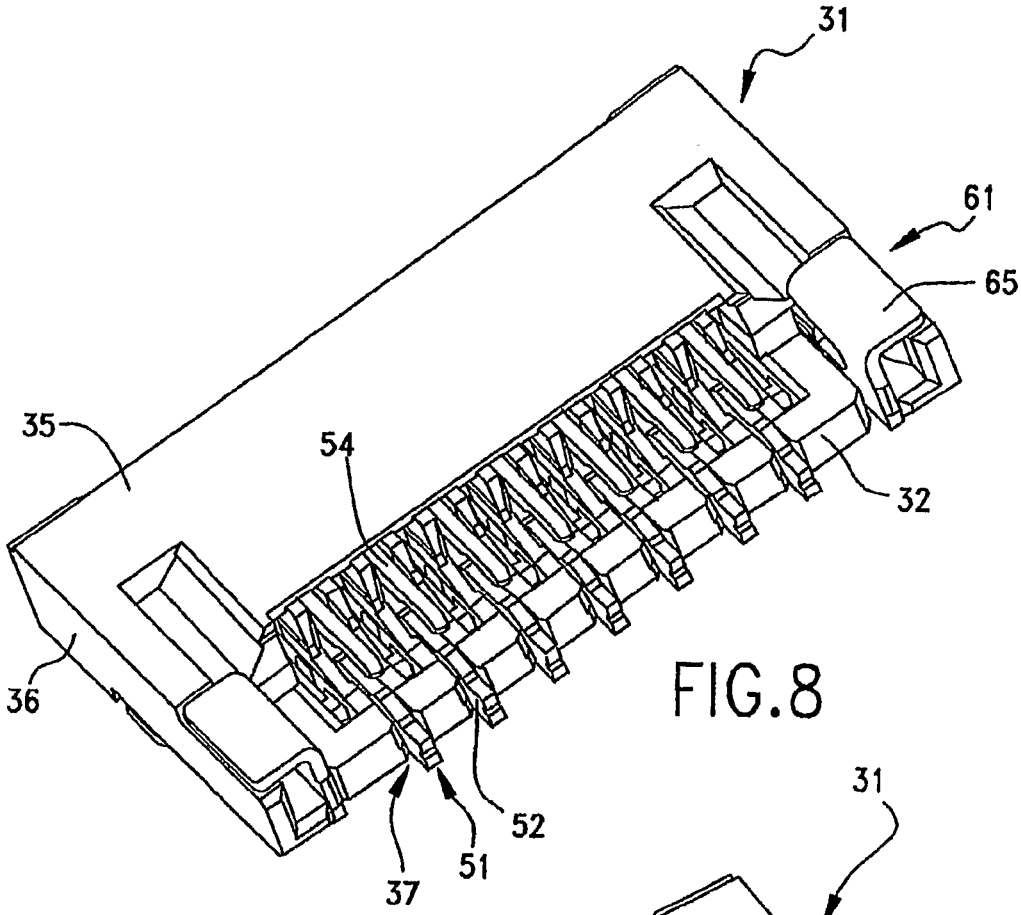
FIG. 8 is a top perspective view of the connector of FIG. 1, taken from the rear with the actuator omitted for clarity.
Figure 9:
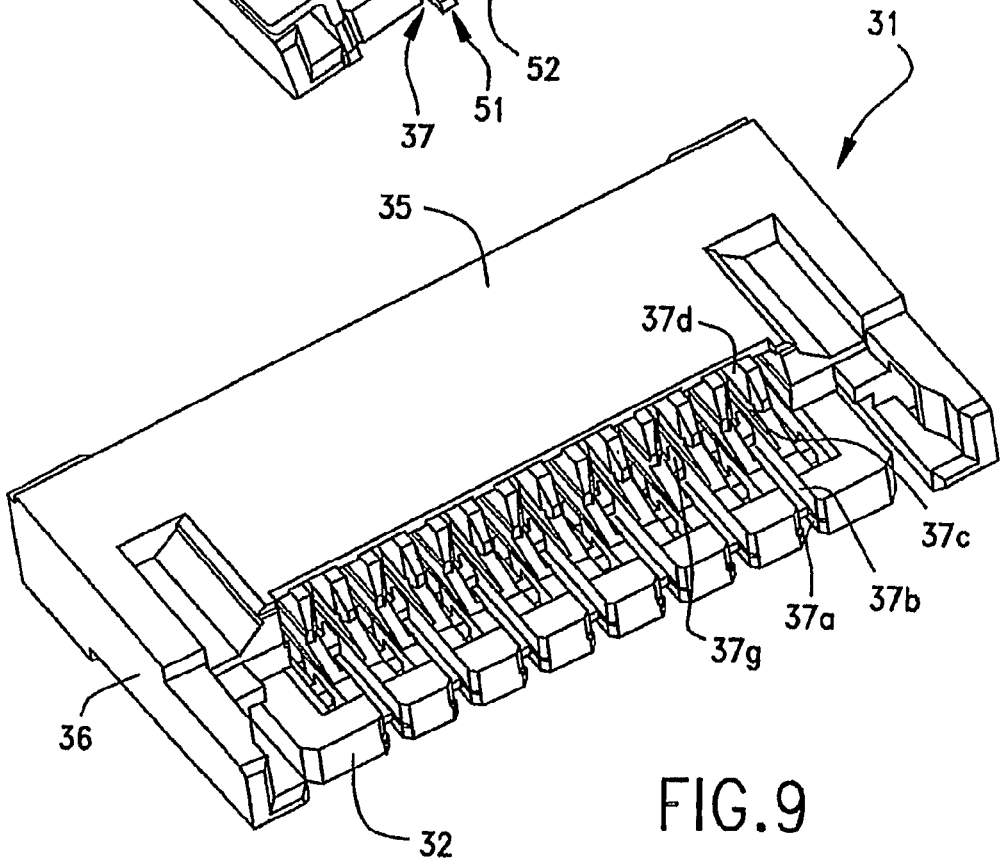
FIG. 9 is a first rear perspective view of a housing of the connector of the present invention.
Figure 10:
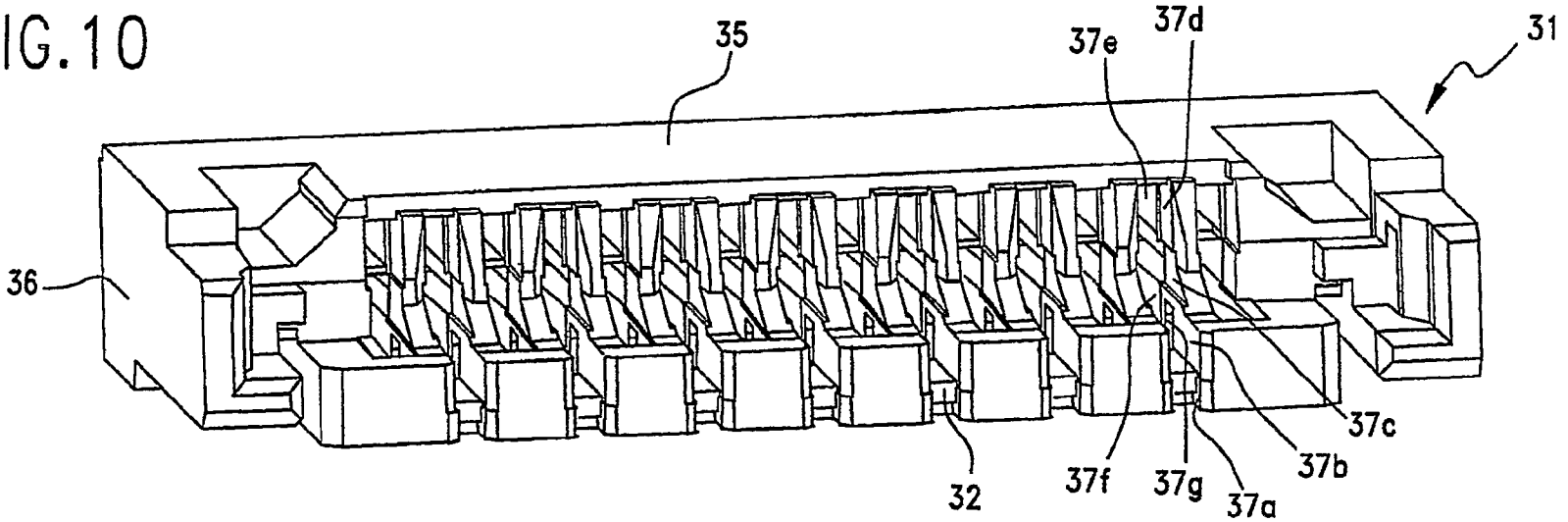
FIG. 10 is a second rear perspective view of the housing of the connector of FIG. 9.
Figure 11:
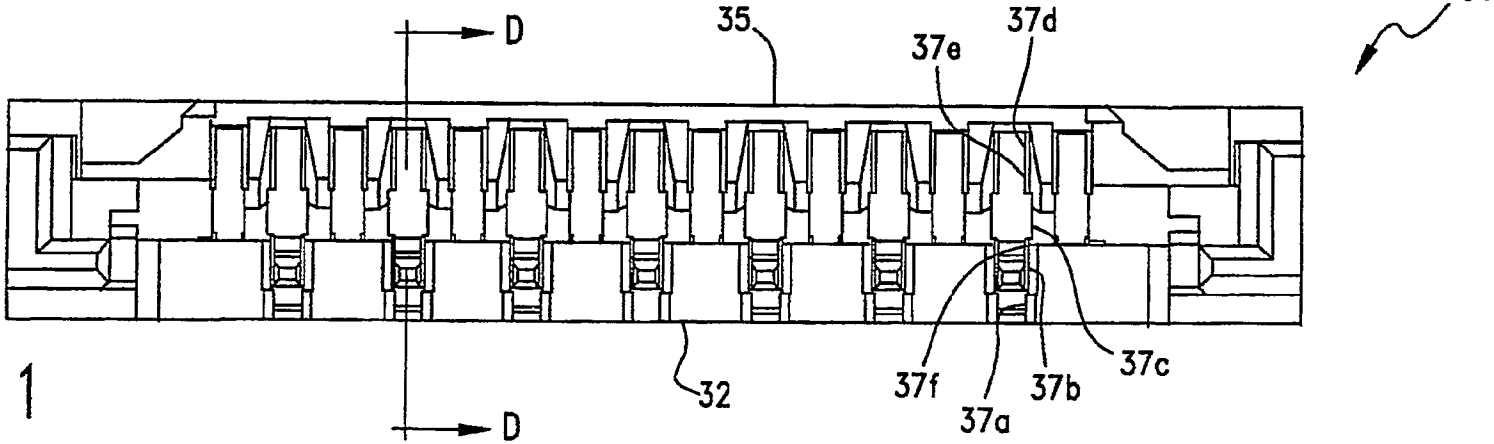
FIG. 11 is a rear elevational view of the housing of the connector.
Figure 12:
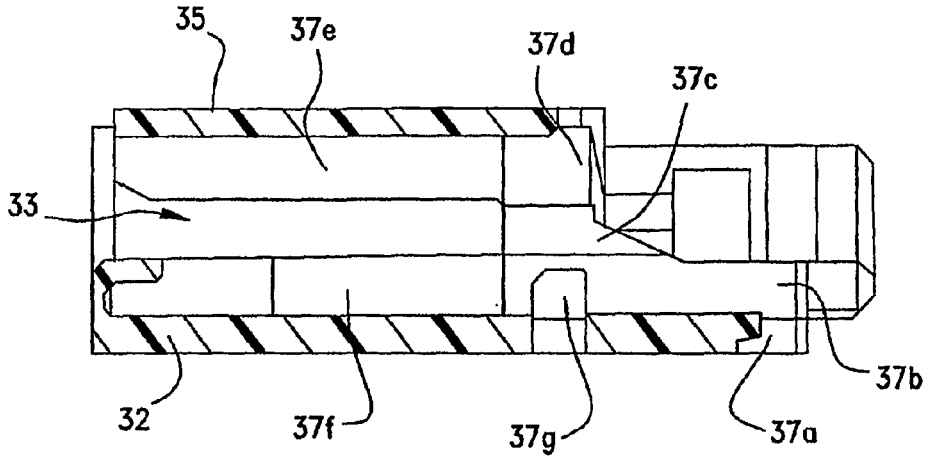
FIG. 12 is a cross-sectional view of the connector housing of FIG. 11, taken along the line D-D thereof.

As seen from comparison between FIGS. 6 and 12, and between FIGS. 8 and 9, the first narrow width portion 37*a* is formed at the bottom of the second terminal holding recess portion 37 near the rear end, corresponds to the side surface of the front bottom portion of the tail portion 52, and is in proximity to or in contact with the side surface. The first broad width portion 37*b* is formed in a position above the first narrow width portion 37*a*, faces the side surface of the bearing portion 53*b*, and is spaced away from the same side surface of the baring portion 53*b*. The second broad width portion 37*c* is formed in a position above the first broad width portion 37*b*, faces the side surface of the connecting portion 55, and is spaced away from the same side surface of the connecting portion 55. The third broad width portion 37*d* is formed in a position above the second broad width portion 37*c*, faces the side surface of the actuating lever portion 54*b*, and is spaced away from the same side surface of the actuating lever portion 54*b*. The second narrow width portion 37*e* is formed in a position on the front side of the third broad width portion 37*d*, faces the side surface of the upper arm portion 54, and is in proximity to or in contact with the same side surface of the upper arm portion 54. The third narrow width portion 37*f* is formed in a position on the front side of the first broad width portion 37*b*, faces the side surface of the lower arm portion 53, and is in proximity to or in contact with the same side surface of the lower arm portion 53. The cut-away portion 37*g* is formed in a position on the front side of the first broad width portion 37*b*, and faces the side surface of the connecting area portion 56 on the rear side of the connecting point to the connecting portion 55.

At the above-mentioned narrow width portions, a gap defined between both side surfaces in each of the second terminal holding recess portions 37 is narrowed so that each of the second terminals 51 can be stably held, and the amount of the gap in dimension is similar to the dimensional value appearing between the side surfaces of the second terminal 51, that is, the value of the thickness of the second terminal 51. Therefore, in the narrow width portions, there is either no or extremely small gaps left between the side surfaces of the second terminal holding recess portion 37 and the side surfaces of the second terminal 51.

On the other hand, in the broad width portions, a wide gap is defined between both sides of each of the second terminal holding recess portions 37, and the amount of the gap in dimension is rather larger than the thickness of the second terminal 51. Therefore, at each of the broad width portions, the gap between the side surface of the second terminal holding recess portion 37 and the side surface of the second terminal 51 is large so that a space extends along the entire circumference of the part of each terminal surrounded by the broad width portions. Hence, even if melted flux goes up along the side surfaces of the tail portion 52 while soldering, the creep-up in a manner of capillary action does not occur in the broad width portions, and the flux will not cause any movement to go more. In other words, because of the broad width portions where there are large gaps between the side surfaces of the second terminal holding recess portions 37 and the side surfaces of the second terminals 51, flux movement in a similar manner to capillary action can be prevented.

In the example shown in the drawing figures, at the second broad width portion 37*c*, the gap between the both side surfaces of the second terminal holding recess part 37 is wider than the gaps thereof at the neighboring first broad width portion 37*b* and the third broad width portions 37*d*. In other words, the second broad width portions 37*c* is formed so that the gap is wider than the gaps formed by the neighboring first broad width portion 37*b* and the third broad width portion 37*d*. Therefore, since the connecting portion 55 is not restricted by the side surfaces of the second terminal holding recess portion 37, the connecting portion 55 can be freely deformed when the upper arm portion 54 rotates. Further, the gaps between the side surfaces of the second terminal holding recess portion 37 and the side surfaces of the connecting portion 55 becomes significantly large, a considerable space is left along the entire circumference of the connecting portion 55 and accordingly, it is ensured that any flux movement due to the capillary action is prevented. Since flux does not creep up along the side surfaces of the connecting portion 55 and is prevented from reaching the upper arm portion 54, the movable upper arm portion 54 is not adhered to the second terminal holding recess portion 37, and thus rotational movements of the upper arm portion 54 is not hampered. In addition, the contact portion 54*a* of the upper arm portion 54 is not contaminated by flux, and thus any failure in electrical connection does not occur between the contact portion 54*a* and the conductive leads of the flat cable 71.

In the cut-away portion 37*g*, the second terminal holding recess portion 37 does not have both side surfaces. Therefore, in the cut-away portion 37, there is no side surface of the second terminal holding recess portion 37, which faces the side surface of the second terminal 51. Hence, even if melted flux creeps up along the side surfaces of the tail portion 52 while soldering, no more flux creep-up due to the capillary action occurs at the cut-away portion 37*g*. In other words, movements of flux due to the capillary action can be prevented by the cut-away portion 37*g*. Note that it is preferred that the cut-away portion 37*g* be completely exposed up to the top surface of the terminal, and provided so that a space is formed along the entire circumference of an auxiliary portion of each terminal.

The cut-away portion 37*g* faces the side surface of the connecting area portion 56, at the rear side of the connecting point to the connecting portion 55. Therefore, the side surface of the connecting area portion 56 which serves as a movable portion is not restricted by the side surfaces of the second terminal holding recess portion 37 and that is why the connecting area portion 56 can be deformed freely as the upper arm portion 54 rotates. Moreover, at the cut-away portion 37*g*, there are no side surfaces of the second terminal holding recess portion 37, which faces the side surfaces of the connecting area portion 56. Thus, movements of flux due to the capillary action can be surely prevented. This prevents the flux from moving along the side surfaces of the connecting area portion 56 and reaching the connecting portion 55, and also prevents the flux from reaching a point of the connecting area portion 56 on the front side of the connecting point with the connecting portion 55. Thus, the connecting portion 55 and the connecting area portion 56 both working as movable parts are not adhered to the second terminal holding recess portion 37 by flux, and deformations of the connecting portion 55 and the connecting area portion 56 are not inhibited. Moreover, the contacting portion 54*a* of the upper arm portion 54 and the cable supporting portion 53*a* of the lower arm portion 53 are not contaminated by flux.

Note that the locations and number of the broad width portions and cut-away portion 37*g* formed can be varied as required. Further, the dimensions of the broad width portions and cut-away portion 37*g* may be appropriately determined as required. Moreover, either the broad width portions or the cut-away portion 37*g* may be omitted.

Here, the second terminal holding recess portion 37 is used as an example, however, it is preferred that each of the first terminal holding recess portions 34 should similarly have broad width portions or a cut-away portion 37*g*. In other words, as described in FIG. 15, at a cut-away portion 37*g*, there are no side surfaces of the first terminal holding recess portion 34, and the first terminal holding recess portion 34 has no side surfaces which face the side surface of the first terminal 41 at the cut-away portion 37*g*. Moreover, a broad width portion such as the second broad width portion 37*c* is provided, and, since there is no flux-creep-up due to the capillary action at the cut-away portion 37*g* or the broad width portions, flux movements can be prevented. Further, although the description was only about how to avoid flux-creep-up, solder-creep-up is prevented consequently by avoiding flux-creep-up. This is because melted flux has a higher fluidity than that of melted solder, and that is why melted flux creeps up along the surfaces of the terminals quicker than melted solder. Therefore, a creep-up of melted solder follows a creep-up of flux. This means that, once flux-creep-up is prevented, solder-creep-up can also be prevented.

Next, operations to connect the flat cable 71 to the connector 10 are described.

Figure 13:
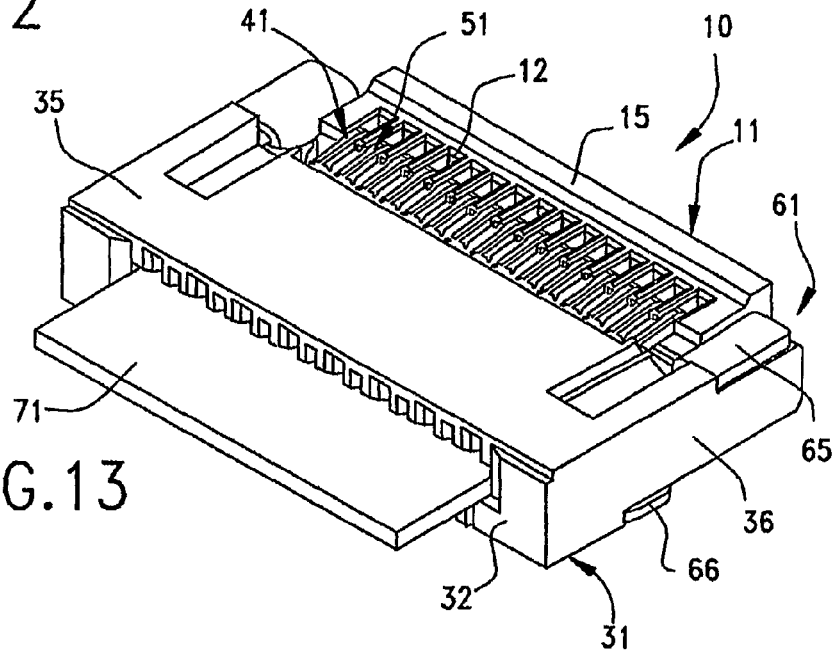
FIG. 13 is a perspective view of the connector of FIG. 1, with the actuator closed.
Figure 14:
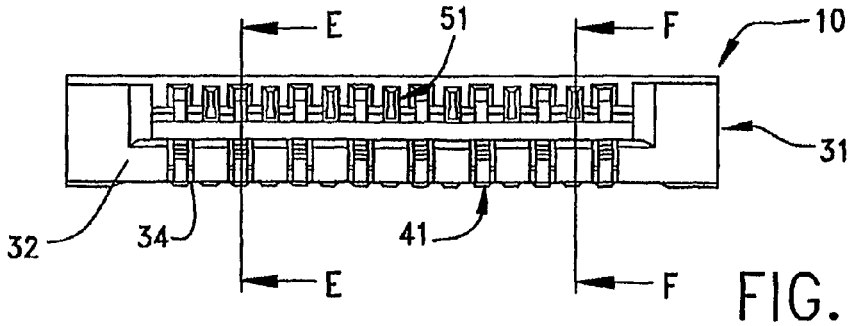
FIG. 14 is a front elevational view of the connector of FIG. 13.
Figure 18:
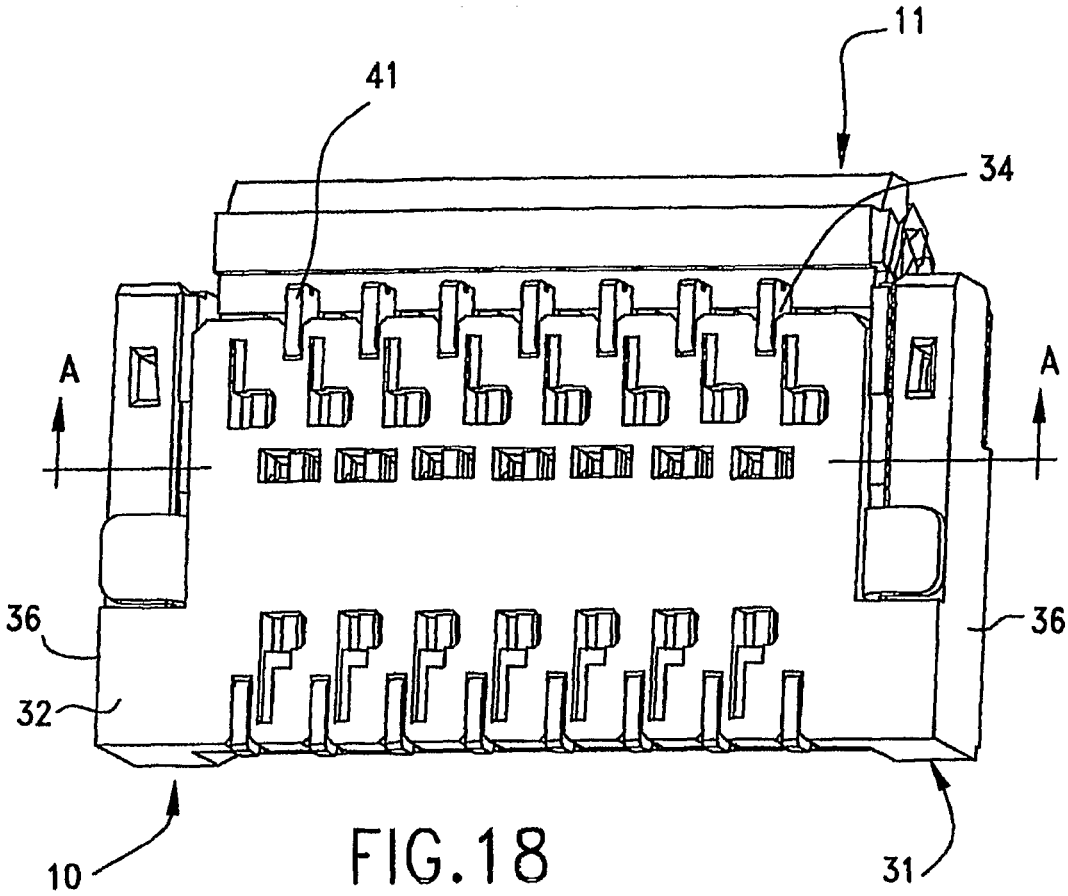
FIG. 18 is a perspective view of the bottom of the connector of FIG. 1.
Figure 19:
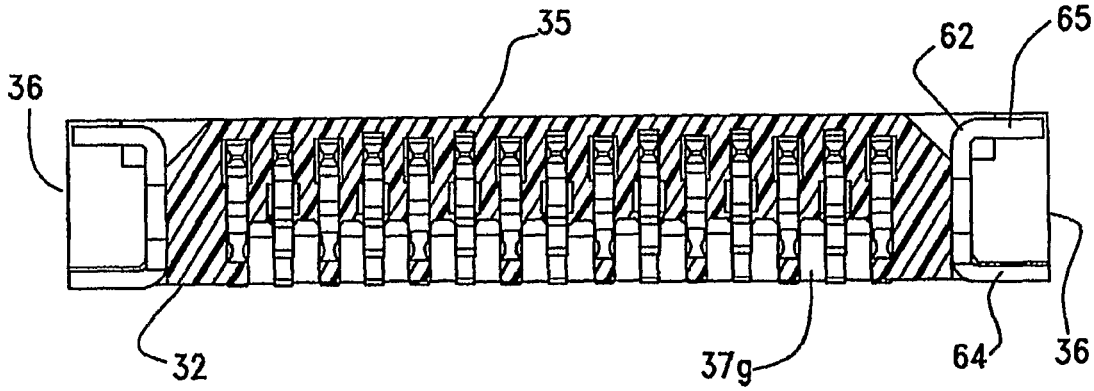
FIG. 19 is a sectional view of the connector of FIG. 18, taken along the line A-A thereof.

FIG. 13 is a perspective view of the cable connector according to the embodiment of the present invention in a state where the actuator is at a closed position. FIG. 14 is a front view of the cable connector according to the embodiment of the present invention in a state where the actuator is at the closed position. FIG. 15 is a cross-sectional view of the cable connector according to the embodiment of the present invention, taken along the arrows E-E of FIG. 14 in a state where the actuator is at the closed position. FIG. 16 is a cross-sectional view of the cable connector according to the embodiment of the present invention, taken along the arrows F-F of FIG. 14 in a state where the actuator is at the closed position.

Here, in the flat cable 71, a plurality of, for example, fifteen foil-type conductive leads are juxtaposed in parallel with one another at a predetermined pitch, for example, at a pitch of approximately 0.3 mm, on an insulating layer which has electrically insulating properties. The top sides of the conductive leads are coated with another insulating layer. At the end of the flat cable 71 to be inserted into the insertion opening 33 of the connector 10, the top surfaces of the conductive leads are exposed in an area along a predetermined length. In the example shown in FIGS. 13 through 16, it is assumed that the conductive leads are exposed on the top side of the flat cable 71.

To connect the flat cable 71 to the connector 10, a longitudinal end of the flat cable 71 is first inserted into the insertion opening 33 of the housing 31. At this time, as shown in FIGS. 1 through 7, the actuator 11 is brought to the open position in advance. Thereafter, an operator moves the longitudinal end of the flat cable 71 towards the insertion opening 33 of the housing 31. Consequently, the longitudinal end of the flat cable 71 is inserted into the insertion opening 33. Note that the flat cable 71 is moved while the surface where the conductive leads are exposed face up.

Then, the tip of the flat cable 71 is inserted into a space between the upper arm portion 44 and the lower arm portion 43 of each of the first terminals 41 accommodated in each of the first terminal holding recess portions 34, and also into a space defined between the upper arm portion 54 and the lower arm portion 53 of each of the second terminals 51 accommodated in each of the second terminal holding recess portions 37. At this time, as shown in FIG. 16, as the tip of the flat cable 71 comes in contact with the connecting portion 55 of the second terminal 51, the longitudinal position of the flat cable 71 is set in position, while completing the insertion of the flat cable 71.

Next, an operator operates the actuator 11 by his/her finger or the like so that the actuator 11 at the open position as shown in FIGS. 1 through 7 is moved to the closed position as shown in FIGS. 13 through 16. At this time, the actuator 11 is moved to the closed position by changing the attitude or position of the actuator 11 in the clockwise direction in FIGS. 5 through 7.

Accordingly, the main body 15 of the actuator 11 rotates, and becomes almost parallel with the insertion direction of the flat cable 71 as shown in FIGS. 13 through 16. In addition, the second shaft portion 17*b* rotates so that the second shaft portion 17*b* becomes nearly horizontal as shown in FIG. 15. In other words, the longer axis of the oval shape cross section of the second shaft portion 17*b* becomes nearly horizontal.

Therefore, as shown in FIG. 15, the second shaft portion 17*b* pushes away the bearing portion 43*b* and the actuating lever portion 44*b* so that the gap between them is expanded, and the second shaft portion 17*b* also pushes the actuating lever portion 44*b* upward. Therefore, the connecting portion 45 and the connecting area portion 46 are elastically deformed, and the whole part of the upper arm portion 44 rotates so that the relative angle between the upper arm portion 44 and the lower arm portion 43 changes and the tip end of the upper arm portion 44 moves downward. Thereafter, the contact portion 44*a* moves closer to the cable supporting portion 43*a* and is pressed against the conductive leads of the flat cable 71. Hence, the exposed conductive leads on the surface of the flat cable 71 come in contact with the contact portion 44*a* to establish an electrical connecting portion. Thus, the conductive leads are electrically connected to the first terminals 41, and thus electrically conducted to a conductive path of the substrate via the connecting pad on the surface of the substrate, to which the tail portion 42 is connected.

Note that the upper arm portion 44 has some spring properties and elastically deform by being pressed against the flat cable 71. Therefore, connection between the conductive leads and the contact portion 44*a* can be well-maintained. Moreover, the cable supporting portion 43*a* of the lower arm portion 43 is located to face the contact portion 44*a*, which ensures that the flat cable 71 is supported by the cable supporting portion 43*a* and also ensures that the connection between the conductive leads and the contact portion 44*a* is well-maintained.

Similarly to above, as shown in FIG. 16, the second shaft portion 17*b* pushes the bearing portion 53*b* and the actuating lever portion 54*b* so that the gap between them is expanded, and the second shaft portion 17*b* pushes the actuating lever portion 54*b* upward. Therefore, the connecting portion 55 and the connecting area portion 56 are elastically deformed, and the whole part of the upper arm portion 54 rotates so that the relative angle between the upper arm portion 54 and the lower arm portion 53 changes and the tip end of the upper arm portion 54 moves downward. Thereafter, the contact portion 54*a* moves closer to the cable supporting portion 53*a* and is pressed against the conductive leads of the flat cable 71. Hence, the exposed conductive leads on the surface of the flat cable 71 are in contact with the contact portion 54*a* to establish an electrical connecting portion. Thus, the conductive leads are electrically connected to the second terminals 51, and thus electrically conducted to a conductive path of the substrate via the connecting pad on the surface of the substrate, to which the tail portion 52 is connected.

Note that the upper arm portion 54 has some spring properties and elastically deform by being pressed against the flat cable 71. Therefore, connection between the conductive leads and the contact portion 54*a* can be well-maintained. Moreover, the cable supporting portion 53*a* of the lower arm portion 53 is located to face the contact portion 54*a*, which ensures that the flat cable 71 is supported by the cable supporting portion 53*a* and also ensures that the connection between the conductive leads and the contact portion 54*a* is well-maintained.

As described so far, in the present embodiment, each of the first terminals 41 is provided with the tail portion 42 and the contact part 44*a*, and each of the second terminals 51 is provided with the tail portion 52 and the contact portion 54*a*. In addition, each of the first terminal holding recess portions 34 and the second terminal holding recess portions 37 has broad width portions or a cut-away portions 37*g* formed in the terminal holding walls facing the external surfaces of each of the first terminals 41 and the second terminals 51, between the tail portion 42 and a part corresponding to the tail portion 52, and the contact portion 44*a* and a part corresponding to the contact part 54*a*.

Accordingly, it becomes possible to make sure that flux-creep-up does not occur even with a simple structure. Therefore, the contact portions 44*a* and 54*a* are not contaminated by flux, thus increasing reliability of the connector 10.

Further, the broad width portion or the cut-away portion 37*g* is formed between the tail portion 42 and the part corresponding to the tail portion 52, and a part corresponding to a movable part in each of the first terminal holding recess portions 34 and the second terminal holding recess portions 37. Therefore, the movable portions of the first terminals 41 and the second terminals 51 are not adhered to the first terminal holding recess portions 34 and the second terminal recess portions 37 by flux.

Note that the movable portions of the first terminals 41 and the second terminals 51 are, for example, the upper arm portion 44 and 54, the connecting parts 45 and 55, the connecting area portions 46 and 56, and the like. However, any part of the first terminals 41 and the second terminals 51 can be the movable portions as long as they move as the attitude of the actuator 11 is changed.

Furthermore, the broad width portions or the cut-away portion 37*g* is formed at a part corresponding to the movable portion in each of the first terminal holding recess portion 34 and the second terminal holding recess portion 37. Therefore, the movable portion is not restricted by each of the first terminal holding recess portion 34 and the second terminal holding recess portions 37, so the movable portion can move freely.

Note that the present invention is not limited to the foregoing embodiment; the present invention may be modified in various ways based on the gist of the present invention, and these modifications are not to be omitted from the scope of the present invention as claimed in the appended claims.

What is claimed is:

1. A cable connector, comprising:

a housing, the housing including:

an opening for receiving an end of a flat cable therein, a plurality of terminal recesses, and a plurality of conductive terminals disposed in the terminal recesses for connecting to conductive leads of the flat cable;

wherein:

each conductive terminal is provided with at least one solder connecting portion, for adhering to conductive pads by soldering, and at least one contact portion, for contacting the conductive leads;

each terminal recess being partly defined by at least one terminal holding wall facing an external surface of the conductive terminal received therein, at least one broad width portion, and a cut-away portion, each broad width portion and the cut-away portion being formed between given parts of the terminal holding wall which face the solder connecting portion and contact portion, respectively; and the cut-away portion extends through the housing.

2. The cable connector according to claim 1, wherein either each broad width portion or the cut-away portion is formed between given parts of the terminal holding wall which face the solder connecting portion and movable portions of the conductive terminal, respectively.

3. The cable connector according to claim 1, wherein either each broad width portion or the cut-away portion is formed between given parts of the terminal holding wall which faces the movable portions of the conductive terminal.

4. The cable connector according to claim 1, further including an actuator mounted to the housing for movement between a first position, at which the flat cable can be inserted into the opening, and a second position, at which the conductive terminals are pressed into contact with the conductive leads, each conductive terminal further including a first arm portion and a second arm portion, both arm portions extending lengthwise in the housing, and a thin connecting portion connecting the arm portions.

5. The cable connector according to claim 4, wherein either each broad width portion or the cut-away portion is formed between given parts of the terminal holding wall which faces the solder connecting portion.

* * * * *